US006821157B2

(12) United States Patent
Brändström et al.

(10) Patent No.: US 6,821,157 B2
(45) Date of Patent: Nov. 23, 2004

(54) PORTABLE TOOL CONNECTED TO AN OPERATION CONTROLLING AND /OR MONITORING UNIT VIA A CABLE

(75) Inventors: Ulf Roland Brändström, Johanneshov (SE); Carl Johan Erik Wallgren, Stockholm (SE)

(73) Assignee: Atlas Copco Tools AB, Nacka (SE)

( * ) Notice: Subject to any disclaimer, the term of this patent is extended or adjusted under 35 U.S.C. 154(b) by 356 days.

(21) Appl. No.: 10/152,181

(22) Filed: Nov. 29, 2001

(65) Prior Publication Data

US 2002/0144832 A1 Oct. 10, 2002

(30) Foreign Application Priority Data

Nov. 29, 2000 (SE) ..... 0004379

(51) Int. Cl.[7] ..... H01R 25/00
(52) U.S. Cl. ..... 439/638; 173/20
(58) Field of Search ..... 439/638, 651, 439/568; 310/50; 173/2, 20, 171, 217; 200/51 R

(56) References Cited

U.S. PATENT DOCUMENTS 3,386,004 A * 5/1968 Dwyer ..... 361/50
3,843,224 A * 10/1974 Gerke et al. ..... 439/366
4,463,228 A * 7/1984 Osika ..... 200/51 R
4,954,922 A * 9/1990 Gaus et al. ..... 361/42
5,167,535 A * 12/1992 Kovacik et al. ..... 439/620
5,491,418 A * 2/1996 Alfaro et al. ..... 324/402
6,049,045 A * 4/2000 Becker et al. ..... 200/51 R
6,390,205 B2 * 5/2002 Wallgren et al. ..... 173/2

* cited by examiner

*Primary Examiner*—Neil Abrams
(74) *Attorney, Agent, or Firm*—Frishauf, Holtz, Goodman & Chick, P.C.

(57) ABSTRACT

A portable tool is connected to a remotely located operation controlling and/or monitoring control it via a multi-core cable. The multi-core cable is connected to the tool by a standard type multi-connector plug and jack connection to supply electric power and/or electric signals between the tool and the control unit. At least one signal producing element is provided on an upgrading module. The upgrading module is insertable between the tool and the multi-core cable via mating multi-connector plug and jack connections, and forms a readily exchangeable adapter. The upgrading module is individually designed to meet the demands of a particular operator, thereby adapting a standard type portable tool to a certain application without involving any re-building of the tool.

12 Claims, 1 Drawing Sheet

PORTABLE TOOL CONNECTED TO AN OPERATION CONTROLLING AND /OR MONITORING UNIT VIA A CABLE

FIELD OF THE INVENTION

The invention relates to a portable tool of the type that is connected to a remote operation controlling and/or monitoring unit via a multi-core cable, wherein the cable is provided at its one end with a multi-connector plug for connection with a mating multi-connector jack on the tool so as to communicate electric power as well as electric signals between the tool and the control unit.

BACKGROUND OF THE INVENTION

In certain types of portable tools, electric power nut runners in particular, not only electric power is communicated via the multi-core cable but also information signals and operation command signals related to the nut runner operation. For instance, torque magnitude and rotation angle signals related to tightening operations as well as command signals from operator maneuvered controls on the nut runner may be transferred from the nut runner to the control unit, whereas the direct nut runner operation control is accomplished via variations of the parameters of the electric current delivered from the control unit to the nut runner.

Each nut runner model is designed to provide a certain level of signal communication and operation control features, and the communication necessary to accomplish this is carried out through the multi-core cable via the multi-connector plug and jack interface between the cable and the nut runner, but also through the wiring and equipment comprised in the nut runner itself.

Today there is a problem for tool suppliers, power nut runner suppliers in particular, to provide such a large range of optional tool models so as to satisfy all upcoming demands for tools adapted for various applications. This means that there is a very large number of combinations of functional features to cover, and since a rebuilding of a power nut runner according to specific demands is a rather expensive operation, usually involving redesign of the nut runner housing and/or fitting of auxiliary equipment inside and outside the nut runner housing, this is a problem every tool supplier would like to get rid of.

SUMMARY OF THE INVENTION

The main object of the invention is to provide a portable tool connected to a remote operation controlling an/or monitoring unit via a multi-core cable and a multi-connector plug and jack connection, whereby the above problems are solved. The tool according to the invention is advantageous in that the tool itself does not have to be adapted by redesign to a specific application or to be rebuilt to add auxiliary functional features. Instead, specific operational features may be added to the tool without requiring any redesign of, for instance, the tool housing.

Further characteristic features and advantages will appear from the following specification and claims.

A preferred embodiment of the invention is described in detail below with reference to the accompanying drawings.

DETAILED DESCRIPTION

Figure 1:
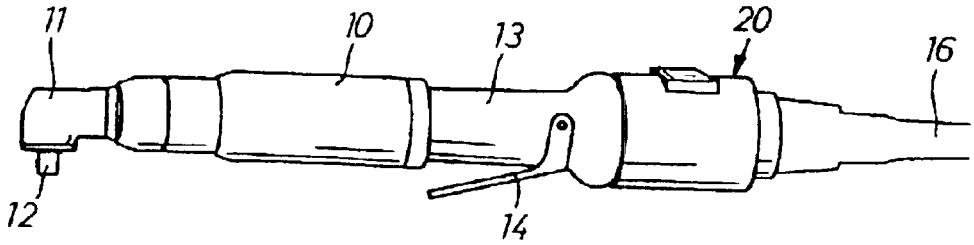
FIG. 1 shows a perspective side view of an electric power tool designed in accordance with the invention.
Figure 2:
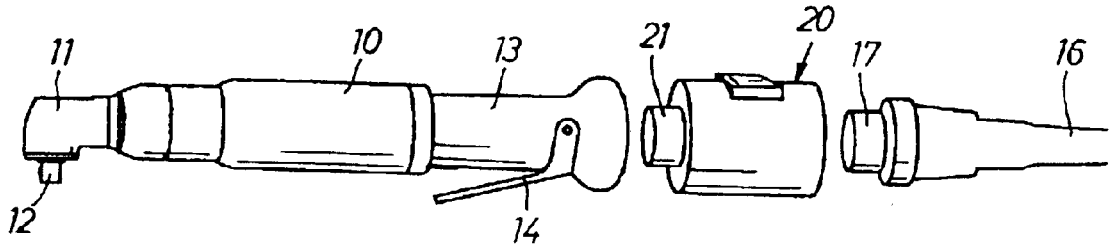
FIG. 2 shows the power tool in FIG. 1 disconnected from its power supply and signal transferring cable.

The portable tool in the example illustrated in the drawing figures is an electric power nut runner comprising an electric motor and sensing means for detection of operation parameter values like output torque magnitude and rotation angle. This is a conventional type of power tool and does not in itself form any part of the invention. Therefore, the details of the tool are not specifically described in detail.

However, the illustrated power nut runner comprises a housing 10 which at its forward end comprises an angle head 11 supporting an output shaft 12 and which at its rear end is formed with a handle 13. An on/off type power switch is manually controlled by a lever 14.

The nut runner is connected to a remotely located operation controlling and monitoring control unit (not shown) via a multi-core cable 16. This cable 16 comprises a number of cores for power supply to the nut runner motor and a number of cores for signal transfer between the tool and the control unit. In a well known manner, the cable 16 is connected to the tool via a standard type multi-connector plug 17 carried on the cable 16 and a mating standard type multi-connector jack (not shown) on the nut runner.

In order to provide the nut runner with various maneuver and/or signal producing means according to specific operator demands, there is provided an upgrading module 20 between the cable 16 and the nut runner. This upgrading module 20 is provided on one side with a multi-connector plug 21 identical with the plug 17 on the cable 16 and mating with the jack on the nut runner and on the opposite side with a connector jack (not shown) identical with the jack on the nut runner and mating with the plug 17 on the cable 16. Preferably, the multi-connector plugs and jacks are of the circular cross section type, which will give a good allround mechanical stability to the connections.

Although not shown in the drawing figures, the standard type connector plugs 17,21 and jacks are as always provided with locking means by which unintentional disconnection of the cable 16 and upgrading module 20 from each other and the nut runner, respectively, is prevented.

Detailed descriptions of the standard type multi-connector plugs and jacks are excluded from this specification, because these items are not per se parts of the invention.

As described above, the upgrading unit 20 is interconnectable between the nut runner and the cable 16 as an adapter which forms an in-line link of the communication string between the nut runner and the control unit.

Figure 3:
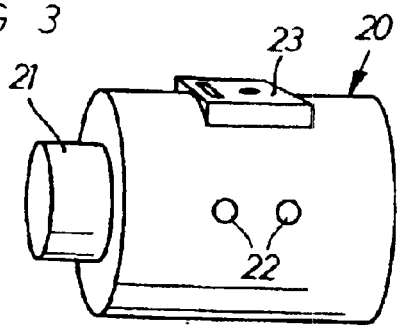
FIG. 3 shows, on a larger scale, an upgrading module according to one embodiment of the invention.
Figure 4:
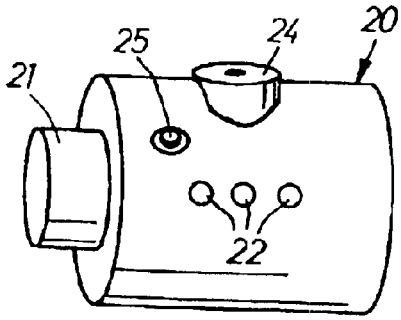
FIG. 4 shows, on a larger scale, an upgrading module according to an alternative embodiment of the invention.

Apart from the lever controlled power switch on the nut runner handle 13, all signal communication means are located to the upgrading module 20. Depending on what operational functions are requested by the operator an individually designed upgrading unit 20 can be provided to satisfy his demands. For instance, the upgrading unit 20 may be provided with one or more signal lights 22 and/or buzzers for operator information purposes, see FIGS. 3 and 4, a bar-code reader 23 (FIG. 3) for working object identification, an ultra-sound emitter 24 (FIG. 4) for tool locating purposes, a switch controlled by a push button 25 for tool operation command signals, etc. These and further features may provided in several combinations.

According to the invention, the specific nut runner features required by a certain operator are easily added to a standard type nut runner without involving any costly and expensive rebuilding of the standard nut runner. To this end, all optional extra features are located to the upgrading unit 20 which is easily connectable and removable in relation to the nut runner. This means that the tool supplier could reduce the number of nut runner models to just a few basic models, and he does not have to rebuild the nut runners to each and every specific customer demand. Instead, a specifically designed and equipped upgrading unit 20 in the form of an adapter can easily be interconnected between the standard nut runner and the power/signal communicating cable 16. This new system also means that one upgrading unit of a specific design providing certain features could be readily exchanged by another upgrading unit having a different design and providing other features. All there is required is a disconnection of the multi-connector plug/jack interfaces between the cable 16, the adapter 20 and the tool, removing the present upgrading unit and fit another upgrading unit. This means that a power nut runner fitted with a certain set of maneuver and/or signal producing means suitable for a particular application can easily be re-equipped with means providing operational features suitable for quite another application.

What is claimed is:

1. A portable power tool, comprising:

at least one signal producing element for delivering at least one of command signals and operation related signals;

an operation control unit, located remotely from the tool, for at least one of controlling and monitoring the tool;

a multi-core cable connecting the tool to the control unit, and including a multi-connector plug which is connectable with a mating multi-connector jack on the tool to thereby communicate electric power and the at least one of the command and operation related signals between the tool and the control unit; and a separate upgrading module including (i) the at least one signal producing element, (ii) a secondary multi-connector plug on a first side for interconnection with the multi-connector jack on the tool, and (iii) a secondary multi-connector jack on a second side for interconnection with the multi-connector plug on the cable;

wherein the at least one signal producing element is specifically adapted to particular tool operator demands, and the upgrading module comprises a disconnectable adapter which is adapted to be interchangeably inserted between the cable and the tool.

2. The power tool according to claim 1, wherein the at least one signal producing element comprises an alerting or warning signal emitting device.

3. The power tool according to claim 1, wherein the at least one signal producing element comprises a barcode reader.

4. The power tool according to claim 1, further comprising an electric motor;

wherein the control unit includes a power supply connected to the motor via the cable and the upgrading module.

5. The power tool according to claim 1, wherein the at least one signal producing element comprises a motor operation command signal producing device.

6. The power tool according to claim 1, wherein the upgrading module comprises one of a plurality of interchangeable upgrading modules, and each one of the plurality of upgrading modules is individually equipped with at least one signal producing element which is specifically adapted to meet a certain operator demand.

7. An upgrading module or a portable tool comprising at least one signal producing element communicating with a remotely located operation control unit via a multi-core cable, the cable including a multi-connector plug and the tool including a multi-connector jack, said upgrading module comprising:

the at least one signal producing element;

an integrated multi-connector plug on a first side of the upgrading module for interconnection with the multi-connector jack on the tool; and an integrated multi-connector jack on a second side of the upgrading module for interconnection with the multi-connector plug on the cable;

wherein the upgrading module is insertable as a disconnectable and exchangeable adapter between the tool and the cable.

8. The upgrading module according to claim 7, wherein the upgrading module comprises one of at least two interchangeable upgrading modules, and each one of the at least two interchangeable upgrading modules comprises a combination of signal producing elements specific to the one of the at least two interchangeable upgrading modules and adapted to a specific tool application.

9. The upgrading module according to claim 7, wherein the at least one signal producing element comprises a barcode reader.

10. The upgrading module according to claim 7, further comprising an electric motor;

wherein the control unit includes a power supply connected to the motor via the cable and the upgrading module.

11. The upgrading module according to claim 7, wherein the at least one signal producing element comprises a motor operation command signal producing device.

12. The upgrading module according to claim 7, wherein the upgrading module comprises one of a plurality of interchangeable upgrading modules, and each one of the plurality of upgrading modules is individually equipped with at least one signal producing element which is specifically adapted to meet a certain operator demand.

* * * * *